US005903992A

United States Patent [19]

Eisenberg

[11] Patent Number: 5,903,992

[45] Date of Patent: May 18, 1999

[54] CURVED FRAME STRUCTURE

[76] Inventor: Adam G. Eisenberg, 3 Newport Dr., Princeton Junction, N.J. 08550

[21] Appl. No.: 08/975,873

[22] Filed: Nov. 21, 1997

[51] Int. Cl.[6] ..... G09F 7/00

[52] U.S. Cl. ..... 40/738; 40/605

[58] Field of Search ..... 40/661.01, 711, 40/729, 738, 605; D6/300; 24/303; 403/DIG. 1

[56] References Cited

U.S. PATENT DOCUMENTS

| | | | |
|---|---|---|---|
| D. 239,467 | 4/1976 | den Ouden . | |
| D. 273,355 | 4/1984 | Grind . | |
| D. 290,428 | 6/1987 | Johnson | D6/301 |
| D. 339,240 | 9/1993 | Perkins | D6/303 |
| D. 367,964 | 3/1996 | Baker et al. | D6/302 |
| D. 378,877 | 4/1997 | Lanci | D6/300 |
| 2,823,477 | 2/1958 | Willard | 40/738 X |
| 3,041,761 | 7/1962 | Knox | 40/738 |
| 3,041,762 | 7/1962 | Knox | 40/738 |
| 3,952,437 | 4/1976 | Mitchell . | |
| 4,019,269 | 4/1977 | Vix | 40/738 X |
| 4,115,938 | 9/1978 | Belmuth et al. . | |
| 4,123,862 | 11/1978 | Dyer et al. | 40/729 |
| 4,196,535 | 4/1980 | Heimo | 40/738 |
| 4,302,897 | 12/1981 | Deckys | 40/605 |
| 4,326,349 | 4/1982 | Daughtry . | |
| 4,385,459 | 5/1983 | McGrath et al. | 40/124.4 |
| 4,532,727 | 8/1985 | Klose et al. | 40/729 |
| 4,608,770 | 9/1986 | Gray . | |
| 4,912,863 | 4/1990 | Harvey . | |
| 4,979,325 | 12/1990 | White | 40/738 X |
| 5,544,438 | 8/1996 | Fazekas | 40/605 |
| 5,588,240 | 12/1996 | Zilliox | 40/729 |

*Primary Examiner*—Joanne Silbermann
*Attorney, Agent, or Firm*—Roberts & Mercanti, L.L.P.

[57] ABSTRACT

A curved frame structure comprising a cylindrical segment having transparent concave and convex surfaces containing a slot area therebetween and capable of retaining a photograph in the slot. A top edge and a base edge parallel to the top edge define a height, and a first side edge and a second side edge parallel to the first side edge define a length. The length is at least two times as great as the height. The cylindrical segment has a radius of curvature and capable of photographic display on the concave and convex surfaces. An attaching means on at least one of the edges may attach the cylindrical segment to another cylindrical segment. A method for assembling an integrated structure is disclosed.

20 Claims, 2 Drawing Sheets

CURVED FRAME STRUCTURE

BACKGROUND OF THE INVENTION

1. Field of the Invention

The present invention relates to a curved frame structure. More particularly, the curved frame structure is self-supporting and free-standing. Most particularly, the curved frame structure may be attached with other similar curved frame structures. The present invention provides variations in picture display allowing various combinations of panoramic picture presentations.

2. Brief Description of the Prior Art

Panoramic photographs are those photographs which display a panoramic view of the picture within the photograph. These include panoramic photographs such as the Kodak® Advanced Photo System. These photographs are difficult to display because unlike shorter photographic display frames, the panoramic picture views do not easily lend themselves to desk frame display. Flat stands which hold the panoramic views do not sufficiently provide a comprehensive view of the photograph taken. The angle of view on a horizontal surface, such as a desk, table, night stand, and the like, also limits a proper viewing of the panoramic photograph.

Problematic with flat display and viewing of the panoramic photographs is the depth perception humans have in viewing the world around them with both eyes. Human experience normally sees the world in an expanded horizontal perspective. Panoramic photographs take advantage of this common human experience. The expanded horizontal field presented in a panoramic photograph results in a view which is most compatible with this human experience in viewing the world. However, the flat presentation of a panoramic photograph does not accommodate the human eyes with a depth of view.

A flat representation of the world in a photograph is not readily pleasing to the human eyes, presenting an immediate focus for the eyes to encounter, or "close-up" expectation. This flat portrayal of the world encumbers the proper aesthetic orientation in viewing a photograph in comparison with the real world. This becomes particularly acute with the portrayal of panoramic photographs which extend beyond the natural field of vision commonly seen by humans. Small length photographs, such as 3 inches by 5 inches, or 4 inches by 6 inches, do not accentuate this problem. The field of vision in a small length photograph is focused on a center object, not encouraging the eyes to scan the photograph horizontally. Larger pictures of equal proportions to small length photographs, such as 9 inches by 15 inches, or 15 inches by 25 inches, are similarly appropriate for flat photographic display as the focus of the photograph does not change as compared to the small length photographs. Eyes do not naturally extend to view a larger photograph horizontally, even though the eyes may gradually wander throughout the entire field of the larger photograph. However, the commonly used flat photographic display used for small length photographs is inadequate to accommodate panoramic photographs, which do not have a naturally focused center point. Accordingly, although a flat presentation of a small length photograph is appropriate, as is the flat photographic display of a proportionally large size photograph to the small length photograph, a flat presentation of a photograph having a panoramic view is not aesthetically comfortable as might otherwise be expected and inappropriate for the maximum viewing pleasure of the panoramic photograph.

The art discloses various aspects of picture frame construction.

Curved displays are disclosed in U.S. Pat. No. 3,952,437 (Mitchell). Mitchell discloses a picture frame having spaced end plates with contiguous curved edges for photographic displays.

Picture frames which are horizontally connected are disclosed in U.S. Design Pat. Nos. 239,467 (den Ouden), 273,355 (Grind) and 367,964 (Baker et al.). den Ouden discloses a picture viewer which forms a triangular structure. Grind discloses a modular picture frame with two connected sections. Baker et al. discloses a picture frame having three components.

Picture frames having vertically connected sections are disclosed in U.S. Pat. Nos. 4,115,938 (Belmuth et al.), 4,532,727 (Klose et al.), 4,608,770 (Gray), 4,912,863 (Harvey), 5,544,438 (Fazekas) and 5,588,240 (Zilliox). Belmuth et al. discloses a variable frame assembly in which adjacent frames are joined together by snap-on clips which fit over and engage the sidewalls of the frames. Klose et al. discloses a quick change frame for photographs. Gray discloses a plurality of picture frames that are interconnected with male and female components to form a collage. Harvey discloses a modular picture frame having slots. Fazekas discloses a hinged two portion frame which can be folded together. Zilliox discloses a modular picture frame structure with jigsaw puzzle interconnecting frames.

Although the art of picture frames, as shown in the above references, shows several embodiments of multi-frame systems, the references do not address curved frame structures for panoramic photographs which may be continuously joined.

SUMMARY OF THE INVENTION

The present invention is a curved frame structure. This structure allows for the presentation of panoramic photographs. The present invention comprises a cylindrical segment having transparent concave and convex surfaces containing a slot area therebetween and capable of retaining a photograph in the slot; the surfaces meeting a top edge and a base edge parallel to the top edge defining a height therebetween, and a first side edge and a second side edge parallel to the first side edge defining a length therebetween, the length being at least two times as great as the height; the cylindrical segment having a radius of curvature and capable of photographic display through the concave and convex surfaces; and an attaching means on at least one of the edges for attaching the cylindrical segment to another cylindrical segment. Multiple cylindrical segments may be assembled into a structure. Additionally, a globe piece may be placed on the assembled curved frame structure.

Another aspect of the invention includes a method for assembling an integrated structure comprising the steps of providing a curved frame structure comprising a cylindrical segment having transparent concave and convex surfaces containing a slot area therebetween and capable of retaining a photograph in the slot; the surfaces meeting a top edge and a base edge parallel to the top edge defining a height therebetween, and a first side edge and a second side edge parallel to the first side edge defining a length therebetween, the length being at least two times as great as the height; the cylindrical segment having a radius of curvature and capable of photographic display through the concave and convex surfaces; and an attaching means on at least one of the edges for attaching the cylindrical segment to another cylindrical segment; and, attaching at least a second cylindrical segment thereon.

DETAILED DESCRIPTION OF THE PREFERRED EMBODIMENT

The present invention is a curved frame structure for the presentation of panoramic photographs, which comprises individual curved cylindrical segments and an attaching means. The curved frame structure may be assembled into a photographic display structure. Although each cylindrical segment is self-supporting, cylindrical segments may be attached together to further expand, position or arrange the panoramic pictures within the assembled structure. The expansion of the cylindrical segments may be horizontal, forming a circular structure or extended curved structure, and/or vertically layered. A globe piece configured to fit on top of a multi-tireed circular structure permits continuity of photographic viewing.

Figure 1:
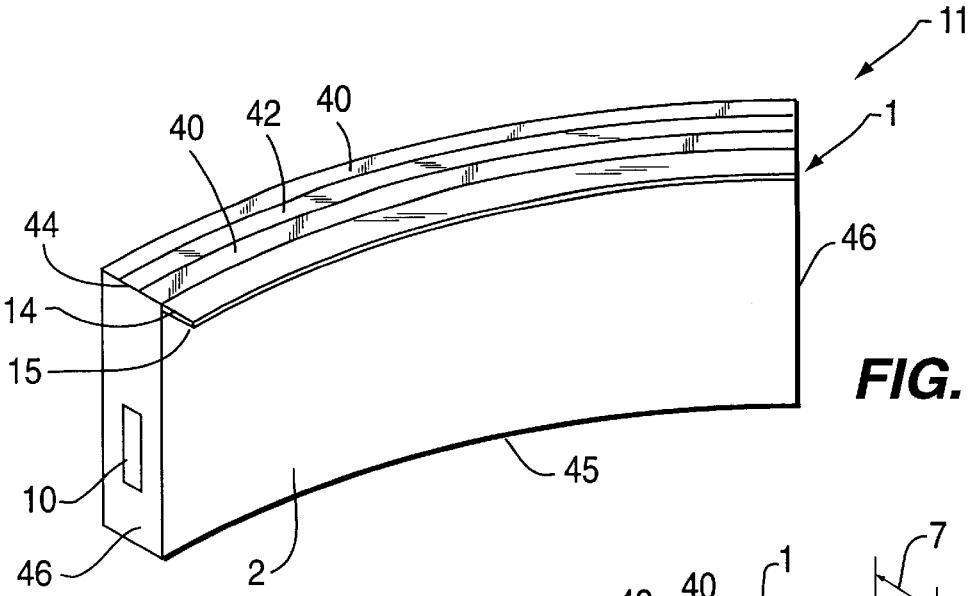
FIG. 1 illustrates a back view of a curved frame structure of the present invention having a cylindrical segment and attaching means.
Figure 2:
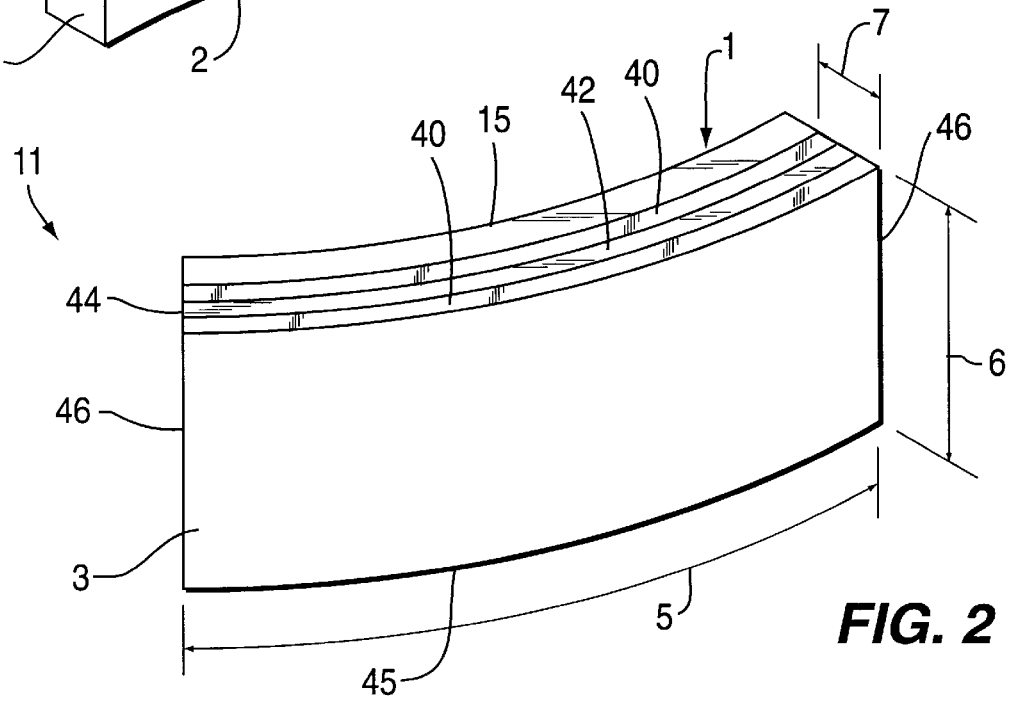
FIG. 2 illustrates a front view of a curved frame structure of the present invention.

As seen in FIGS. 1 and 2, a curved frame structure 11 has a cylindrical segment 1 which is a singular structure that has a top edge 44 and a parallel base edge 45, in addition to two parallel side edges 46. The cylindrical segment 1 also has two curved surfaces which forms a concave side 2 and a convex side 3. The top edge 44, base edge 45 and two side edges 46 define the area of the surfaces, with the top edge 44 and parallel base edge 45 defining a height 6 of the cylindrical segment 1 and the two parallel side edges 46 defining a length 5 of the cylindrical segment 1. The concave surface 2 and convex surface 3 meet the top edge 44 and base edge 45. The length 5 of the cylindrical segment 1 is at least two times the amount as the height 6 of the cylindrical segment 1. Preferably, the length 5 to height 6 ratio (length divided by height) is from about 2 to about 6, more preferably from about 2.5 to about 5, and most preferably from about 3.5 to about 4.5. The cylindrical segment 1 is from about 9 inches or more long, preferably from about 9 inches to about 16 inches long, more preferably from about 9.5 inches to about 14 inches, and most preferably from about 10 inches to about 11.5 inches long. The cylindrical segment 1 is preferably from about 2 inches to about 6 inches in height, more preferably from about 3 inches to about 5 inches, and most preferably from about 3.5 inches to about 4.5 inches in height.

Figure 3:
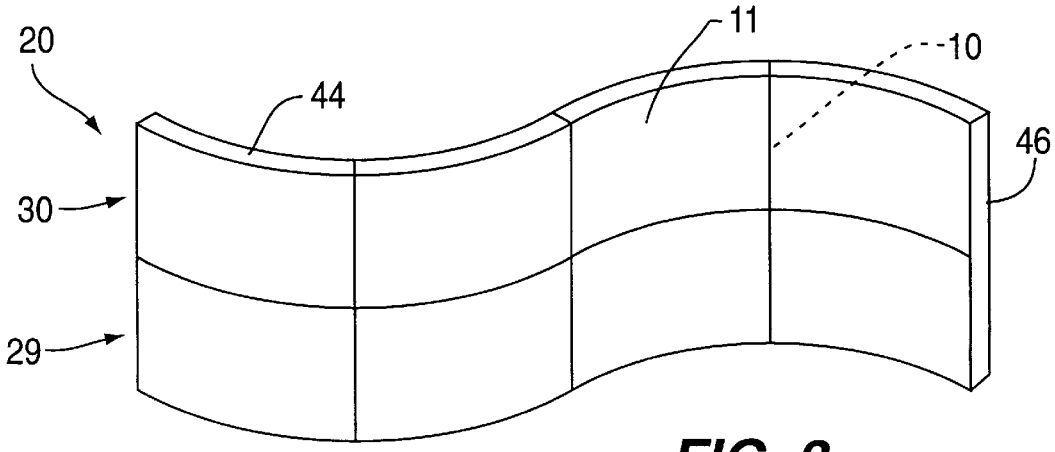
FIG. 3 illustrates a perspective view of an assembled curved frame structure of the present invention having horizontal and vertical build.
Figure 4:
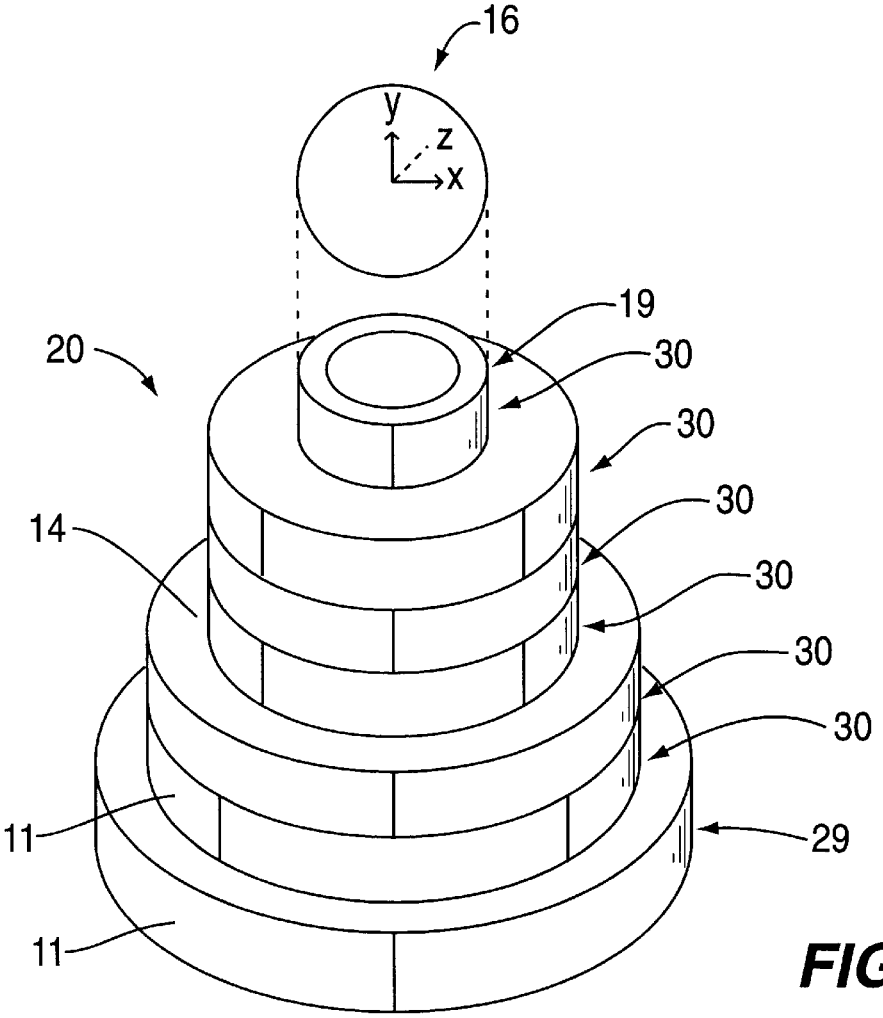
FIG. 4 illustrates a perspective view of the preferred embodiment of an assemble curved frame structure having a circular construction with a globe piece; and, FIG. 5 illustrates a horizontal view of two curved frame structures having vertical build.
Figure 5:
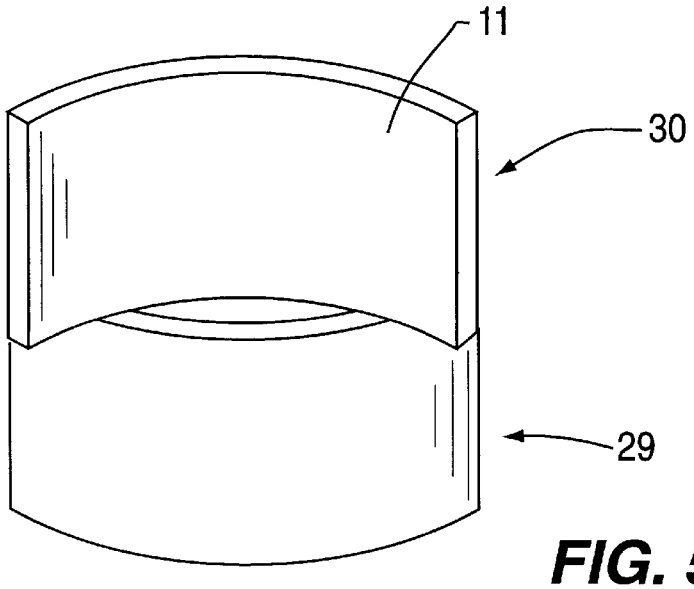

The present invention has a width 7 which aids in the free standing of the curved frame structure 11. The width 7 is from about 0.25 inches to about 1.5 inches, preferably from about 0.3 inches to about 1.0 inch, more preferably from about 0.5 inches to about 1.0 inch, and most preferably from about 0.75 inches to about 1.0 inch. In addition to aiding self-support, the width 7 permits additional vertical layers 30 of equal or greater curvature, as shown in FIGS. 3, 4 and 5, to be placed on top of the cylindrical segment 1. The width 7 of the cylindrical segment 1 is sufficient in relation to the height 6 effective to support the cylindrical segment 1 in a free-standing vertical position and to permit additional tires of vertical cylindrical segments 1 to be placed thereon. As the present invention allows vertical build of the cylindrical segments 1, this feature allows an economy of space on a table, desk, counter, or similar surface. As such, forming structures of vertically stacked singular cylindrical segments 1 is within the discretion of the person arranging the cylindrical segments 1. In certain appropriate panoramic photograph displays and in restricted space locations, singular cylindrical segments 1 forming both the first and second tires may be desired.

The concave 2 and convex 3 surfaces of the cylindrical segment 1 provide an expanded view of the panoramic photographs. The concave 2 and convex 3 surfaces form a slot 40 therebetween, which may have a core area 42. The core area 42 is adjacent to the slot 40 which retains the photograph is place when displayed on the concave surface 2 or convex surface 3. The core area 42 provides a backing to support the photograph within the slot 40. When the cylindrical segments 1 are assembled into a circular structure, as shown in FIG. 4, the panoramic photographs are displayed through the convex surface 3. When the cylindrical segments 1 are assembled into a weaving or rolling structure, as shown in FIG. 3, the panoramic photographs are displayed through both the concave surface 2 and the convex surface 3. Differences in light and shading in panoramic photographs may provide that either the concave 2 or convex 3 surface as a more appropriate display side. Convex surfaces 3 permit enhanced display of panoramic photographs with greater subject continuity. Concave surfaces 2 are better for panoramic photographs with disparate subject matter. As such, the present invention has the advantage of either a concave 2 or convex 3 display. In certain circumstances, panoramic photographs may be displayed through both the concave surface 2 and the convex surface 3 of the same cylindrical segment 1 at the same time.

The curvature of the cylindrical segment 1 is a radius of curvature, preferably having at least a rate of curvature of four degrees per inch. A radius of curvature has a constant rate of curvature about a given or predetermined point within a given cylindrical segment 1. This allows viewing of the displayed panoramic photographs with the proper depth perception, thereby providing a comprehensive view of the panoramic photograph. As the cylindrical segment 1 forms a part or complete circle, the rate of curvature provides the circumference and diameter of the formed structure. At four degrees per inch, nine cylindrical segments 1, each being ten inches long forms a complete circular structure. With cylindrical segments 1 being fifteen inches long, six cylindrical segments 1 form a complete circular structure. The circumference of the base tire 29, shown in FIG. 4, with a curvature of four degrees per inch is ninety inches, having a circular diameter of less than thirty inches. Additional tires 30 built on top of the base tire 29 have diameters equal to or less than the base tire 29. Accordingly, cylindrical segments 1 along these tires have a rate of curvature equal to or greater than four degrees per inch. For example, a tire having a curvature of five degrees per inch has a circumference of seventy-two inches and a diameter of less than twenty-five inches. A tire having a curvature of six degrees per inch has a circumference of sixty inches and a diameter less than twenty inches.

Preferably, each cylindrical segment 1 is made of a light weight material, resulting in a final structure assembly which is easy to lift and/or move. The cylindrical segments 1 are transparent, preferably made of an acrylic or plastic material. Additionally, the cylindrical segments 1 are resilient and not easily shattered or broken. Preferably, the cylindrical segments 1 have minimal or no bordering materials along the edges of the concave 2 and convex 3 surfaces which obstruct the view of the encased panoramic photographs.

The width 7 and curvature of the cylindrical segment 1 allows the cylindrical segment 1 to be free standing or self-supporting on a level horizontal surface, such as a desk, table, night stand, and the like. This permits arrangement of the panoramic photographs in the cylindrical segments 1 in such a way as to not obstruct viewing of the photographs. Interference of the natural tendency of the human eye to horizontally scan a panoramic photograph occurs when external support structures are added to the panoramic display. The present invention minimizes the occurrence of additional support structures to the cylindrical segments 1.

In FIG. 3, several cylindrical segments 1 are attached, or connected, together into an integrated or unitary assembled curved frame structure 20. Two cylindrical segments 1 are attached together either by being in direct physical contact or by having an indirect physical connection where other cylindrical segments 1 are connected between the two cylindrical segments 1. This attached structure of the present invention maximizes the viewing and presentation of expanded photographs. As each cylindrical segment 1 is approximately 9 to 16 inches long, the attached cylindrical segments 1 expand the panoramic viewing of the panoramic photographs to further aid the field of vision when viewed. The attached cylindrical segments 1 permit panoramic photographs to be placed in a continuous line, allowing immediate presentation of several panoramic photographs at one time to a viewer, which is only limited by the viewer's rate of visual sweep of the attached cylindrical segments 1. The length of the attached non-circular photographic display is preferably from about three cylindrical segments or more, more preferably from about four cylindrical segments to about eight cylindrical segments, most preferably from about five cylindrical segments to about six cylindrical segments.

The cylindrical segments 1 are attached together by an attaching means 10. This attaching means 10 may be any connection effective to form the cylindrical segments 1 into an integrated structure 20. The attaching means 10 is capable of extending the cylindrical segment 1 having a given radius of curvature along the generally same direction. This provides that the attached cylindrical segments 1 do not form sharp bends or abrupt angles within the integrated structure 20 when two or more cylindrical segments 1 are horizontally attached. An abrupt angle is any angle which is from about 90° or greater from a tangential line along a cylindrical segment 1 surface within a length of one inch, preferably from about 45° or greater, more preferably from about 30° or greater, and most preferably from about 20° or greater.

The attaching means 10 includes devices which lock two or more cylindrical segments 1 into an integrated structure 20. The attaching means 10 may be frame supports, clips, rods, latches, adhesives, magnets, Velcro, and the like. When the attaching means 10 is a frame support, rod, clip, and the like, the attaching means 10 is preferably curved to align with the curved cylindrical segments 1. However, the attaching means 10 are preferably magnets or Velcro surfaces located on the cylindrical segments 1, as these attaching means 10 may be easily obscured and do not interfere or distract from the viewing of a panoramic photograph. Most preferably, the attaching means 10 is a magnet. The cylindrical segments 1 preferably are attached together in such a way as to permit the integrated structure 20 to be shifted or moved for unitary movement and without disconnecting. The attaching mean 10 may include structural supports which align the side edges 46 when connected.

The cylindrical segments 1 may be assembled to allow panoramic photograph to be displayed in two attached cylindrical segments 1 at the same time. The attached cylindrical segments 1 are attached to align the slot 40 of a first cylindrical segment 1 with the slot 40 of a second cylindrical segment 1, thereby allowing placement of a panoramic photograph to extend between the slot 40 of the first cylindrical segment 1 and the slot 40 of the second cylindrical segment 1. This slot 40 communication between the cylindrical segment 1 allows for proper and versatile placement of the panoramic photographs placed therein to maximize viewing through the concave 2 and convex 3 surfaces.

As shown in FIG. 4, the integrated structure 20 may comprise multiple tires 30, such as a second, third, fourth, or more tires. As the second tire is of a diameter equal to or less than the first tire 29, the cylindrical segments 1 may have lips 14 for additional tires of cylindrical segments 1 to be placed on the first or base tire 29. The second tire may be directly over the first tire 29 or shifted to one side or the other. This second tire may support a third tire with each additional tire supporting other tires. Each of these multiple tires may have a lip 14 to perform this tire support function. The lip 14 projects out from the width 7 of the cylindrical segment 1 an amount sufficient to align with lips 14 of another tire. Preferably, this is from about 0.5 inches to about 4 inches, more preferably from about 1 inch to about 3 inches, and most preferably about 2 inches. The lip 14 additionally have attaching means 10 to secure to multiple tires into an integrated structure 20 in the vertical build direction. The lip 14 also may have a ridge 15 to facilitate tire alignment.

When needed or desired, the curved frame structure 11 may be affixed to a vertical surface. This permits viewing the panoramic photograph at eye level or separate from distracting objects such as those found on a desk or table. Cylindrical segments 1 of the curved frame structure 11 may be attached to the side of a metal file cabinet by any attachment means 10 suitable for that purpose, such as magnets, a fabric partition by Velcro, or the like. When a plurality of two or more curved frame structures 11 are assembled to form an integrated structure 20, similar attaching devices may be used to affix the integrated structure 20 to a vertical surface.

FIG. 4 shows an assemble number of curved frame structures 11 having a circular integrated structure 20 comprising a globe piece 16. The globe piece 16 is placed on and/or within the tireed circular integrated structure 20. The globe piece 16 is spherical with photographic compartments placed within and around the circumference of the globe piece 16. The globe piece 16 has a diameter sufficient to display at least two panoramic photographs which may be placed end-to-end within the globe piece 16. Other, panoramic and non-panoramic photographs also may be placed within the globe piece 16 in conjunction with the first two panoramic photographs. Multiple tires 30 are assembled vertically, with the globe piece 16 placed on the top of the highest vertical tire 19. Preferably, the integrated structure 20 is from about three tires or more, more preferably from about four tires to about six tires, most preferably about five tires. The globe piece 16 is placed above the top tire which preferably has two curved frame structures 11. As such, with a cylindrical segment 1 length of nine inches, the circumference of the final or top tire is eighteen inches and the circular diameter is approximately six inches. With a cylindrical segment 1 length of sixteen inches, the circumference of the final tire is thirty-two inches and the circular diameter is less than eleven inches. Accordingly, the globe piece 16 has a size at its largest diameter of from about six inches or more, preferably from about seven inches to about twenty inches, more preferably from about nine inches to about fifteen inches, and most preferably from about eleven inches to about fourteen inches. The globe piece 16 has a maximum rate of curvature of about twenty degrees per inch, which is also approximately the maximum rate of curvature for the top tire of an integrated structure 20 having a two cylindrical segments 1, each having a length of nine inches. The globe piece 16 allows display of any picture along the x, y, and/or z axis of the globe piece 16. The photographs within the globe piece 16 are inserted into tracks which permit the photographs to overlap, as needed. Preferably, the globe piece 16 comprises two half sections which may be attached with any attaching means, such as clips, rods, magnets, Velcro, ridges, or the like, allowing the photographs to be placed within the globe piece 16. The globe piece 16 is attached to the final tire by any method known in the art, such as interlocking latches, screw mechanism, or may be free-standing. Preferably the globe piece 16 is free-standing on the final tire, allowing it to freely rotate.

In operation, the integrated structure 20 is assembled by providing a cylindrical segment 1 having an attaching means 10 and attaching a second cylindrical segment 1 thereon. This allows for presentation of panoramic photographs, with the cylindrical segments 1 having self-support on a horizontal surface. Panoramic photographs are placed within the cylindrical segments 1 for display. The cylindrical segments 1 are assembled with an extending horizontal or vertical build. Additionally, the integrated structure 20 may be assembled by adding sufficient cylindrical segments 1 so as to form a complete circular structure. The cylindrical segments 1 are attached in a horizontal and vertical direction, with the horizontal direction forming a circular structure and the vertical build having the same circular diameter or decreasing circular diameter as each tire is added. When the final tire of two cylindrical segments 1 is fitted on the structure, a globe piece 16 is placed on the top of the final tire of the curved frame structure 20 in a free-standing manner. In a second assemblage, the cylindrical segments 1 are added horizontally so as to form a curved structure, having a weaving or rolling configuration.

The foregoing summary, description, example and drawings of the invention are not intended to be limiting, but are only exemplary of the inventive features which are defined in the claims.

I claim:

1. A panoramic curved frame structure comprising a cylindrical segment having transparent concave and convex surfaces containing a slot area therebetween and capable of retaining a photograph in the slot; the surfaces meeting a top edge and a base edge parallel to the top edge defining a height therebetween, and a first side edge and a second side edge parallel to the first side edge defining a length therebetween, the length being at least two times as great as the height; the cylindrical segment having a radius of curvature and capable of photographic display through the concave and convex surfaces; and an attaching means oil at least one of the edges for attaching the cylindrical segment to another cylindrical segment, wherein the cylindrical segment is free standing on one edge thereof, and when attached, at least one edge is direct physical contact with the edge of another cylindrical segment.

2. The structure of claim 1, wherein the length has a rate of curvature of at least four degrees per inch.

3. The structure of claim 1, further comprising a core area between the concave and convex surfaces wherein at least one slot is between the core area and at least one of the surfaces.

4. The structure of claim 1, wherein the curved frame structure has a maximum rate of curvature of greater than from about twenty degrees per inch.

5. The structure of claim 1, wherein the cylindrical segment is attached to a second cylindrical segment.

6. The structure of claim 5, wherein additional cylindrical segments are attached to the first and second cylindrical segments.

7. The structure of claim 6, wherein the attached cylindrical segments form a circle.

8. The structure of claim 6, wherein the additional cylindrical segments form circular layers.

9. The structure of claim 8, further comprising a globe piece.

10. The structure of claim 1, wherein at least a second cylindrical segment is attached to the cylindrical segment vertically above the cylindrical segment.

11. The structure of claim 10, wherein additional cylindrical segments are attached vertically above the cylindrical segment in addition to the second cylindrical segment.

12. The structure of claim 1, wherein the attaching means is a magnet.

13. The structure of claim 1, wherein the attaching means is obscured from view.

14. The structure of claim 1, wherein the attaching means is capable of attaching the cylindrical segment to a vertical surface.

15. The structure of claim 1, wherein attaching means is capable of attaching a plurality of cylindrical segments to a vertical surface.

16. The structure of claim 1, wherein the cylindrical segment is from about 3 inches high and about 9 inches long to about 6 inches high and 16 inches long.

17. The structure of claim 15, wherein the cylindrical segment is from about 3.5 inches high and about 10 inches long to about 4.5 inches high and about 11.5 inches long.

18. An assembly of cylindrical segments according to claim 1, forming a curved frame structure having a circular base and circular multiple layers having decreasing diameter, wherein the top layer of the structure comprises two cylindrical segments; the structure further comprises a globe piece, wherein the globe piece is free-standing on the structure.

19. A method for assembling an integrated structure comprising the steps of:

(a) providing a panoramic curved frame structure comprising a cylindrical segment having transparent concave and convex surfaces containing a slot area therebetween aid capable of retaining a photograph in the slot, the surfaces meeting a top edge and a base edge parallel to the top edge defining a height therebetween, and a first side edge and a second side edge parallel to the first side edge defining a length therebetween, the length being at least two times as great as the height; the cylindrical segment having a radius of curvature and capable of photographic display through the concave and convex surfaces; and an attaching means on at least one of the edges for attaching the cylindrical segment to another cylindrical segment, wherein the cylindrical segment is free standing on one edge thereof, and when attached, at least one edge is in direct physical contact with the edge of another cylindrical segment; and, (b) attaching at least a second cylindrical segment thereon.

20. The method of claim 19, further comprising the step of attaching a plurality of cylindrical segments to the cylindrical segment and second cylindrical segment.

* * * * *